United States Patent [19]

Roen

[11] Patent Number: 4,932,560

[45] Date of Patent: Jun. 12, 1990

[54] BAG PAD AND DISPENSER THEREFOR

[75] Inventor: Ralph M. Roen, Longview, Tex.

[73] Assignee: T. C. Manufacturing Company, Inc., Evanston, Ill.

[21] Appl. No.: 320,470

[22] Filed: Mar. 8, 1989

Related U.S. Application Data

[63] Continuation of Ser. No. 148,381, Jan. 25, 1988, abandoned, which is a continuation-in-part of Ser. No. 94,874, Sep. 10, 1987, abandoned.

[51] Int. Cl.[5] ..... B65H 3/34; B65B 67/00

[52] U.S. Cl. ..... 221/26; 211/57.1; 248/95

[58] Field of Search ..... 221/26, 45, 46, 50; 206/554; 211/54.1, 57.1, 59.1; 248/95, 99, 100, 101

[56] References Cited

U.S. PATENT DOCUMENTS

| | | | |
|---|---|---|---|
| 2,982,398 | 5/1961 | Makrauer | 206/57 |
| 3,312,339 | 4/1967 | Million | 206/57 |
| 4,046,257 | 9/1977 | Lehmacher | 206/544 |
| 4,181,069 | 1/1980 | Porter | 93/35 R |

*Primary Examiner*—F. J. Bartuska
*Assistant Examiner*—W. Todd Waffner
*Attorney, Agent, or Firm*—Lee, Mann, Smith, McWilliams & Sweeney

[57] ABSTRACT

A bag pad and dispenser therefor especially arranged for use at the point of sale of, for instance, discount stores, fast food outlets, and the like, in which the bag pad is made up of a number of identical all plastic bags in stacked congruent relation each having front and rear panels, closed bottoms and sides, and tear off lines transversely across the front and rear panels of the respective bags adjacent to but spaced from the top of bags that are congruently located through the thickness of the bag pad and that define a header for the bag pad at which the bags of the pad are adhered together and are free for full separation below the tear off lines, with the dispenser for such bag pad defining a pocket into which the bag pad header is slipped and secured to the dispenser for hanging the bag pad therefrom, which dispenser also defines a securing flange that accommodates anchoring of the dispenser to dispose the bag pad for bagging at the point of sale, and in its bag dispensing relation, in which an area of increased frictional characteristics that is provided on the front panel of each bag is exposed for consecutively manipulating a bag of the pad that is to receive a sold product to open such bag at its front panel for loading without removing the bag from the dispenser, or optionally to totally remove the bag entirely before loading of same.

15 Claims, 4 Drawing Sheets

12
60
62
64
66
68
70
72
74
80
82
84
86
88
90
92
96
14
16
4
6
64A
74A
82A
60A
62A
66A
68A
80A
100

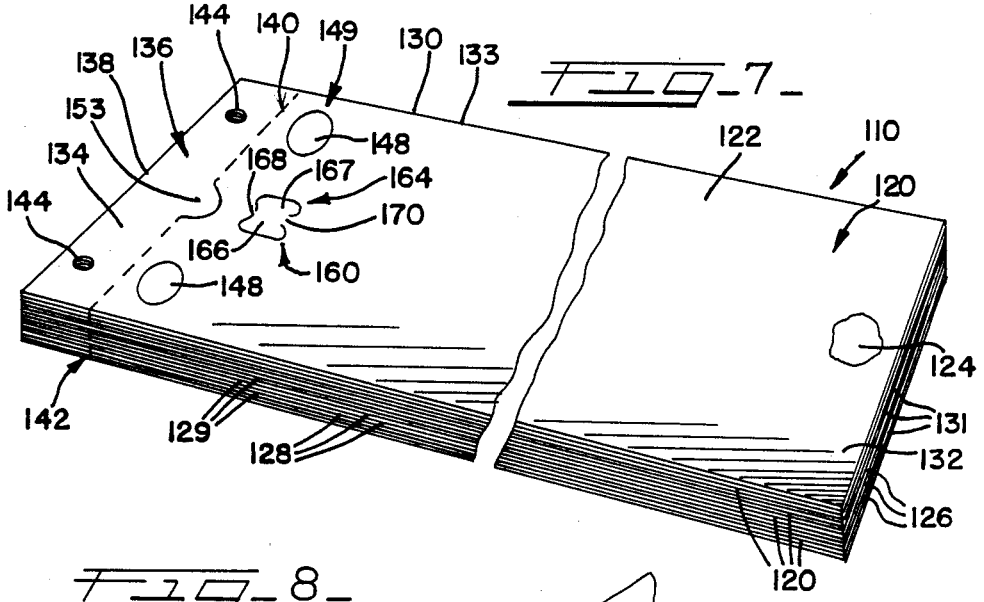
FIG. 7
FIG. 8
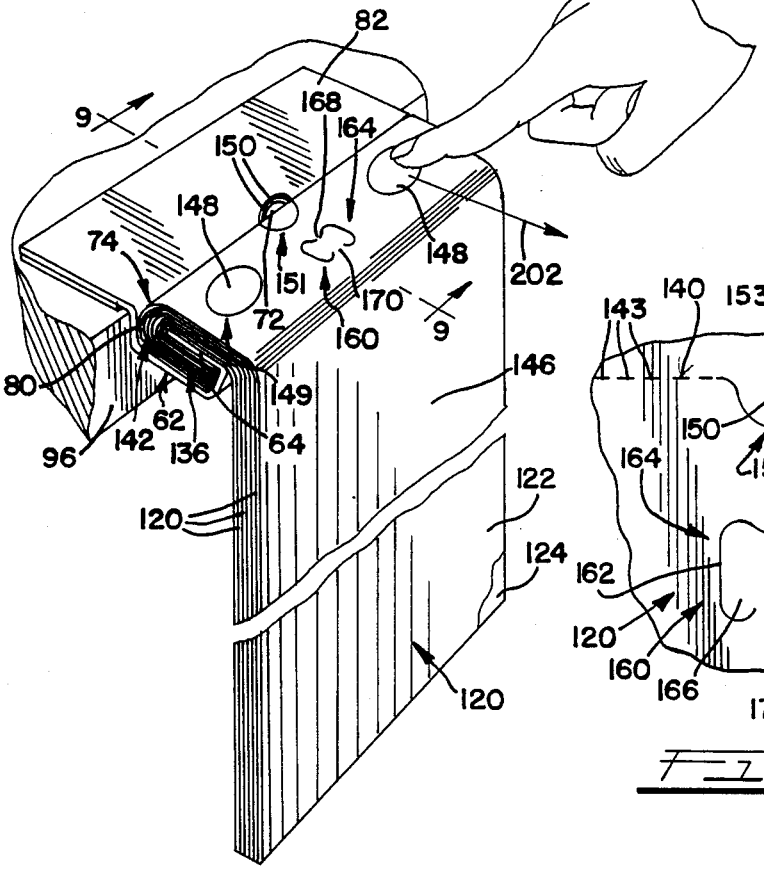
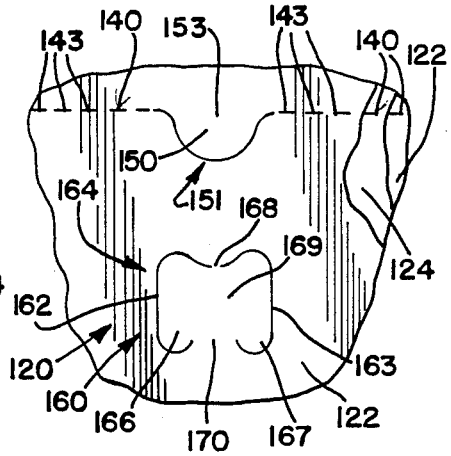
FIG. 7A

BAG PAD AND DISPENSER THEREFOR

This is a continuation of my application Ser. No. 148,381 filed on Jan. 25, 1988, now abandoned, which was a continuation-in-part of my application Ser. No. 094,874 filed on Sept. 10, 1987, now abandoned.

The present invention is directed to all plastic bags incorporated in bag pads, and a dispenser therefor, for use to provide for bagging of products at customer check out counter facilities of, for instance, the so-called "fast food" retail outlets, for fast and efficient bagging of packaged cooked food for immediate carry away by the carry out customer, or for bagging anywhere where there is located a check out counter and the bag dispenser may be mounted within easy reach of the individual responsible for the bagging activities.

Prior to the advent of bag pads, the bagging of sold products for the carry out customer presented problems for the individual doing the bagging at, for instance, the facility check out counter. Individual and loose plastic bags stored in a box or some kind of a container ordinarily take time for the individual doing the bagging to grasp and orientate for bagging purposes. Stacked loose plastic bags tend to cling together and do not readily accommodate removal one at a time from a container or the like in which they are stored after which the individual doing the bagging must open the bag so that it can be used. One common approach to the problem is to place a number of the individual loose plastic bags in a stack on the check out counter adjacent to where the bagging is to take place. As such bags are very light in weight, the stack of bags or some of the bags in the stack are all too quickly blown off the counter onto the floor if a near by door is opened and such bags are caught in the incoming current of air.

Bag pads, on the other hand, involve the bags that are to be employed for the bagging purpose to be adhered together only at the bag tops at what is known as a "header", with the individual bags having tear off lines equally spaced from the tops of the bags, whereby the bags may be torn off the bag pad one at a time as needed for bagging purposes. As the bags are removed from the bag pad it becomes increasingly difficult to remove the bags that remain part of the bag pad.

A principal object of the present invention is to provide a bag pad and dispenser therefor in which the bag pad is made up of a number of identical, congruently stacked, all plastic bags (that may number from about twenty-five to about one hundred bags per pad) with the bags of the pad being adhered together at the bag tops, and thus at what is known in the art as the bag pad header, with the basic body of each of the bags being free of the bag pad, and thus adapted for ready separation from the bag pad, starting at the front of the pad, for use as needed, at, for instance, the customer check out counters of discount stores or fast food facilities, with the dispenser being arranged for ready application of the bag pad header thereto, and the dispenser being arranged to be mounted adjacent the work station where the bagging is to take place, with the bags that are made available hanging vertically from the dispenser, and without taking up or using any valuable counter space or the like that the bagging person has to work from in performing his bagging operation.

Another principal object of the present invention is to provide a bag pad and dispenser of the type indicated whereby the dispenser may be removably mounted so as to dispose the bags being dispensed by same in vertical hanging relation and conveniently facing and within the reach of the person doing the bagging, whereby such person can open the bag of the bag pad facing him, insert whatever is to be loaded into the bag that represents the customer's carry out purchase, separate the bag from the pad and its dispenser, close the bag over the purchase, and hand the closed bag to the customer for ready carry out of the customer purchased product, or alternately, initially fully separate the bag from the pad and its dispenser and then load the bag with the customer's carry out purchase.

Yet another principal object of this invention is to provide a bag pad arrangement and dispenser therefor in which the bag pad arrangement is formed to define a header that includes the bag tops and extends down to congruently located bag tear off lines in the respective bag front and rear panels, with the dispenser defining a pocket, into which the bag pad header is inserted for bag tear off purposes, and a securing flange that is oriented to dispose the bag pad being dispensed in vertically oriented and hanging bag tear off relation, with the bags of the bag pad arrangement involved including a pressure sensitive spot of increased frictional characteristics adjacent the top of the bag and adjacent the bag pad header but below the tear off lines, that is braced by the dispenser when the bag pad is mounted for such dispensing use, whereby the individual bags of the pad as they are used may be opened for loading without removal from the dispenser for the bag pad, and then removed, or optionally, the individual bags may be totally removed from the bag pad and dispenser without first loading same.

In accordance with the invention, a bag pad of plastic bags is formed in which each bag is conventionally made from flexible plastic material of film thickness dimensions, such as polyethylene or polypropolene sheeting or tubing, in which the bags of the pad are identical and are in flattened congruently oriented relation with each bag defining front and rear panels that define the usual external and internal surfacings and that are sealed together at the bottom and sides of the bag, with the front and rear panels of each bag each defining a tear off line of perforations that extend transversely and congruently of the individual bags, and that are located adjacent but spaced from the top of the bag. The bags are heat sealed together at their tops to form the bag pad header that extends down the bag pad to the congruently positioned bag tear off lines, which define the bag tear off section of the bag pad.

The front panel of each bag of the bag pad has one or several areas of increased frictional characteristics, as compared to those of the respective bag panel interior surfacings, formed at the exterior of the front panel, that may be defined by a spot of suitable pigmented ink or the like, or just be roughened, and that are located adjacent but below the bag front panel tear off line, with the areas in question of the bag pad being congruently located throughout the thickness of the bag. The bag pad may also be punctured therethrough adjacent but below the bag pad tear lines for fixedly mounting the bag pad against movement from the dispenser.

Further in accordance with the invention, the dispenser is in the form of a sheet or lamina member formed to define a generally U-shaped bag pad holder portion defining spaced holder and base sides that in turn define a pocket that is open along the holder side of the dispenser holder portion through which the bag pad header is inserted into the dispenser pocket up to approximately the tear off lines to form the bag tear off or dispensing relation of the bag pad to the dispenser. The dispenser also includes a mounting flange disposed along the dispenser base side and oriented relative to the dispenser holder portion to dispose the bag pad to extend a short distance in a horizontal mode and then to hang vertically from the dispenser in the bag dispensing relation of same, with the bag pad overlying the dispenser holder side, and with suitable means being provided to securing the mounting flange in place.

The invention contemplates that the bag pad may be suitably releasably gripped by the dispenser for holding in its bag dispensing relation, with the bag pad areas of increased frictional characteristics being braced by the dispenser when used so that the individual separating the bags from the bag pad may press the exposed bag area against the dispenser and move the front panel of the exposed bag away from the dispenser pocket opening and in the direction of tear off of the bag from the bag pad, which effects separation of the pad exposed bag front panel along its tear off line to open such bag for loading of the bag while it remains on the dispenser.

Other objects, uses, and advantages will be obvious or become apparent from a consideration of the following detailed description and the application drawings, in which like reference numerals indicate like parts throughout the several views.

In the drawings:

FIG. 1 is a diagrammatic perspective view of a bag pad arranged in accordance with the present invention, with parts broken away to expose underlying parts;

FIG. 1A is a fragmental plan view of the bag pad diagrammatically illustrating the area or spot of increased coefficient of friction that is provided on each bag front panel adjacent the front panel tear off line, and the bag pad through puncture that in the bag pad there illustrated is formed in alignment with the indicated bag spots for restraining the bag pad header relative to its dispenser in the embodiment of FIGS. 2–4;

Figure 1:
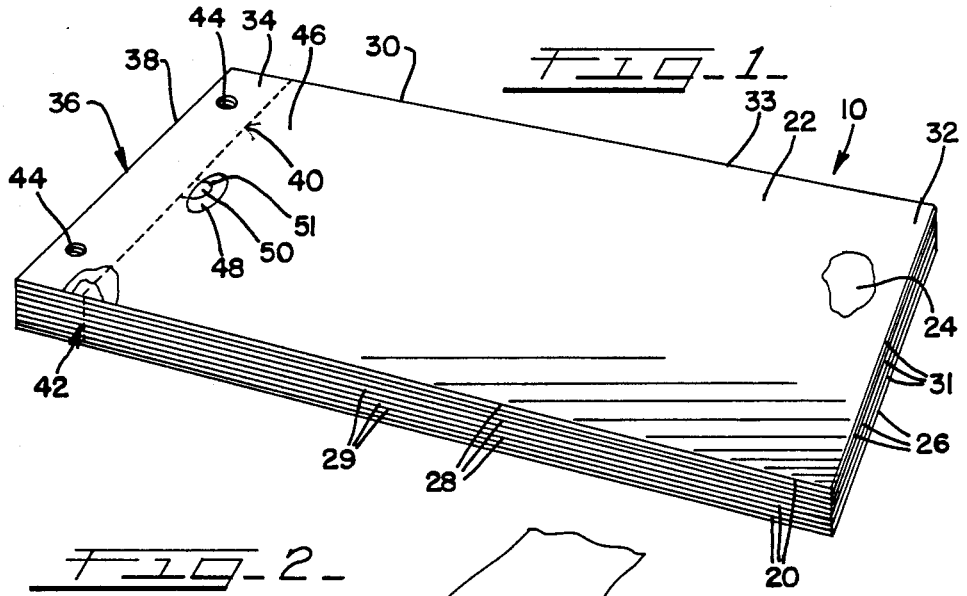
Figure 2:
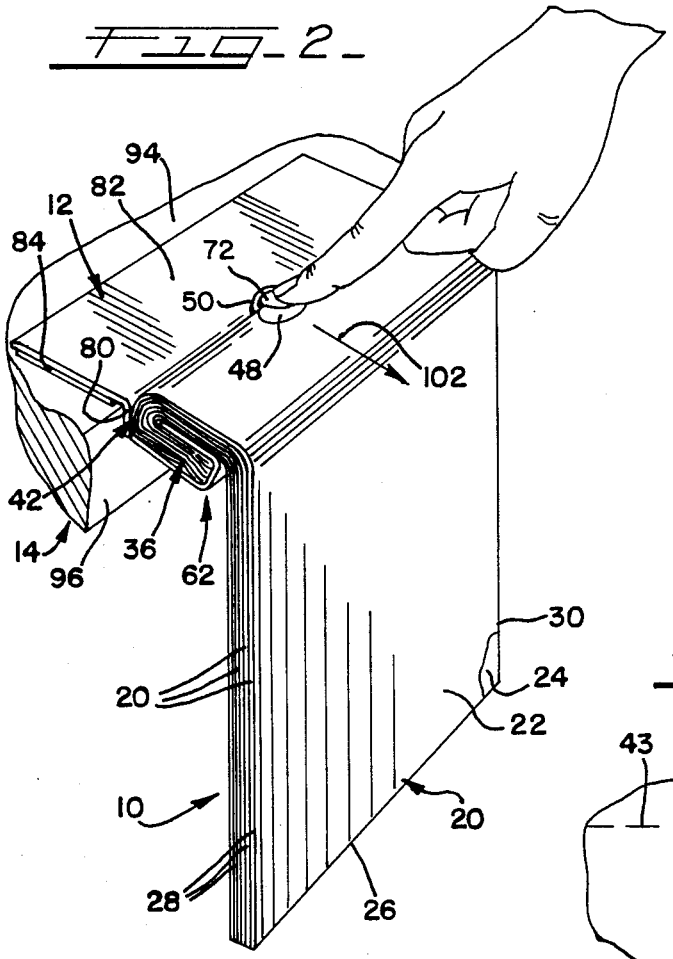
FIG. 2 is a view similar to that of FIG. 1, but showing the bag pad applied to the dispenser of the present application, with the manner of opening the individual bags of the pad and separating same from the bag pad held by the dispenser being diagrammatically illustrated.
Figure 1A:
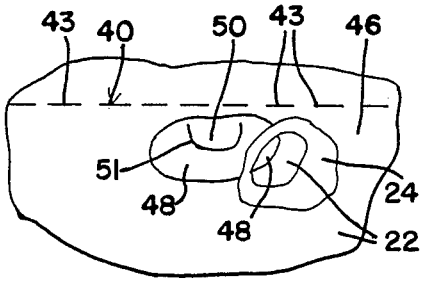
Figures 3, 4, 5, 6:
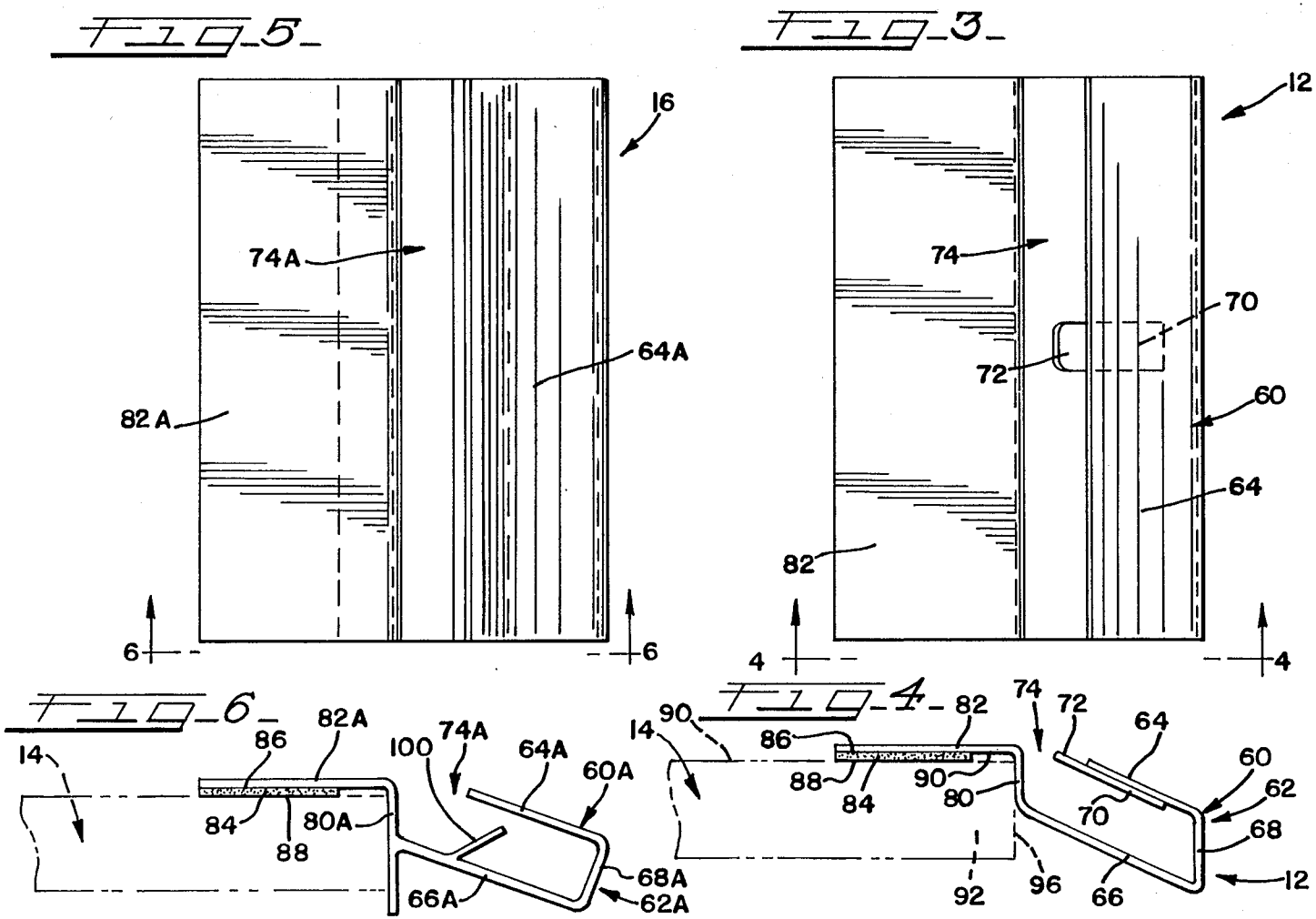
FIG. 3 is a top plan view of the metallic dispenser shown in FIG. 2, with the bag pad being omitted.
FIG. 4 is an edge view of the metallic dispenser shown in FIG. 3, FIG. 4 being taken substantially along line 4—4 of FIG. 3.
FIG. 5 is a plan view of a similar dispenser that is formed from a suitable plastic such as polyvinyl chloride or the like, in which the individual dispensers are formed to be sized as shown in FIG. 3 from an elongate extruded strip having the one piece configuration shown in FIG. 6.
FIG. 6 is an edge view of the dispenser shown in FIG. 5.
Figure 9:
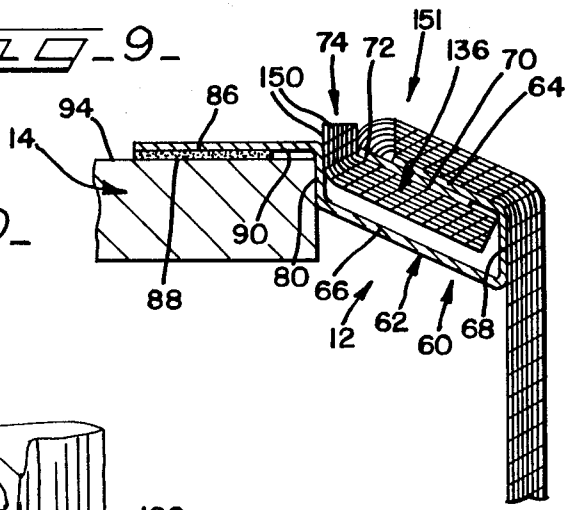
Figure 10A:
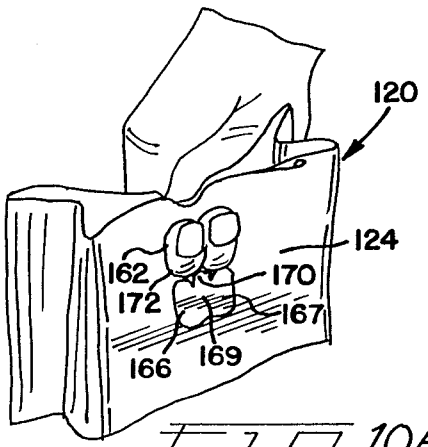
Figure 10:
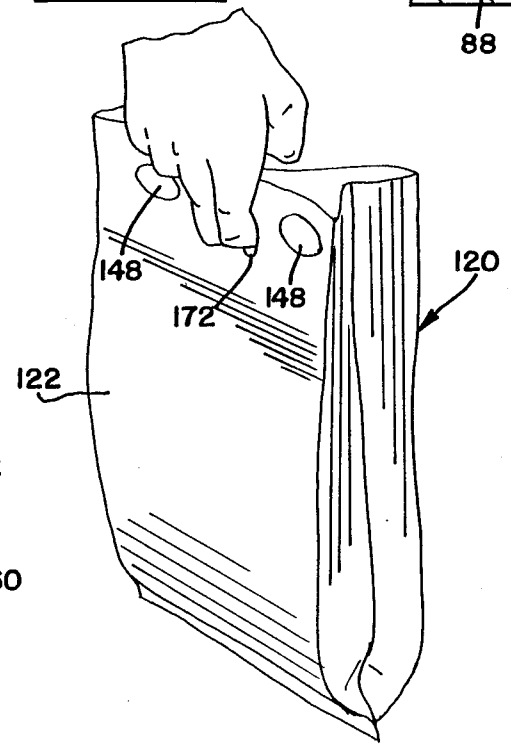
Figure 11:
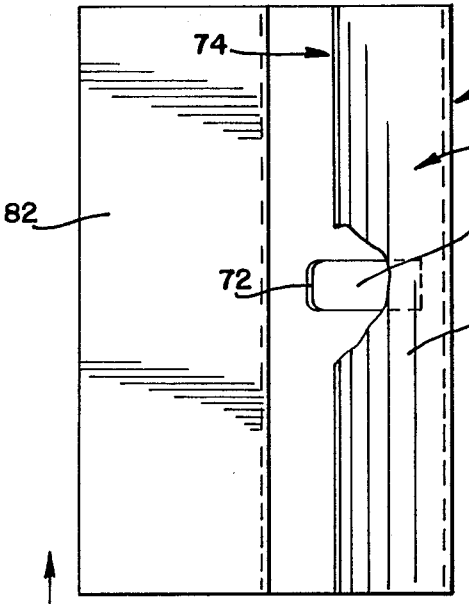
Figure 12:
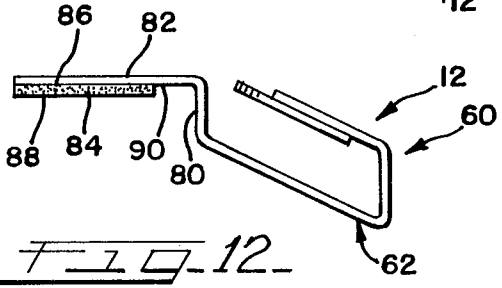

FIGS. 7, 7A, and 8 are similar to FIGS. 1, 1A and 2, respectively, illustrating a modified and preferred bag pad;

FIG. 9 is a sectional view taken along line 9—9 of FIG. 8;

FIG. 10 is a perspective view illustrating a finger hold arrangement provided by the bag of FIGS. 7–9;

FIG. 10A is similar to that of FIG. 10, but shows fragmentally the upper end of the bag of FIG. 10 and as it appears from the opposite side of the side of FIG. 10;

FIG. 11 is a view similar to that of FIG. 3, with a part broken away; and FIG. 12 is a view similar to that of FIG. 4, with the phantom showing of the counter top omitted;

However, it is to be distinctly understood that the specific drawing illustrations provided are supplied primarily to comply with the requirements of the Patent Laws, and that the invention is susceptible of other embodiments or modifications that will be readily apparent to those skilled in the art, and which are intended to be covered by the appended claims.

GENERAL AND SPECIFIC DISCLOSURE

In accordance with the invention, there is provided several bag pad arrangements, namely a bag pad 10 (see FIGS. 1, 1A and 2), and bag pad 110 (see FIGS. 7, 7A and 8) that do have utility in and of themselves, but in accordance with the invention are intended to be applied to dispenser 12 (see FIGS. 2–4, 8 and 9) that is adapted to be affixed to, for instance, a counter top 14 of the type normally found at the point of sale of discount stores, fast food facilities, and the like, and in a manner that avoids taking up or using any valuable counter space that would be otherwise available to the check out personnel. Alternately, the bag pads 10 and 110 may be similarly applied to the alternate dispenser 16 of FIGS. 5 and 6, and mounted in a similar manner for dispensing the bags one by one from the respective bag pads.

The bag pad 10 comprises a plurality of individual bags 20 in flattened, stacked, and congruent relation, with the number of bags 20 in a bag pad 10 depending on the needs of the customer for same, though for an example the bags may vary from about twenty-five to about one hundred in number.

The bags 20 are identical in configuration and make up, and each comprises a front panel 22 and a back panel 24 formed from plastic sheeting and sealed together to define the bag bottom seals 26 and the bag end or side seals 28 and 30, whereby the individual bags 20 are continuously sealed along their sides 29 across their bottoms 31 and along their sides 33.

The bag pad 10 thus defines a lower end 32 and an upper end 34, with the bag pad upper end 34 defining the bag pad header 36 that extends downwardly from the top 38 of the bag pad 10 to tear off lines 40 that are formed in each bag pad front and rear panel 22 and 24 and that in assembling of the bag pad 10 are stacked in congruent relation so as to define a tear off section 42 of the bag pad 10. The header 36 in the form shown is also formed with a pair of apertures 44 that extend through the thickness or depth of the bag pad header 36 and are formed by conventional heat sealing methods so as to affix the consecutively stacked bags together at apertures 44 whereby the header 36 remains assembled as the individual bags 20 are removed from the bag pad. Apertures 44, in one use of bag pad 10, may be hung on nails or hooks that are applied to the respective holes 44, but the principal use envisioned for bag pad 10 is in connection with one of the dispensers 12 or 16.

It will be understood, of course, that the tear off lines 40 are actually lines of rectilinear perforations 43 that facilitate tear off of the individual bags 20 from the bag pad 10.

Further in accordance with the invention, the external surface 46 of each bag front panel 22 has an area 48 of increased frictional characteristics, as compared to the frictional characteristics of the bag panel internal surfacings (which are near zero), formed thereon; in the bag pad form of FIGS. 1 and 2, the area 48 of each bag 20 is centered adjacent the longitudinal axis of the respective bags. The area 48 may be formed from any suitable material, such as a spot of pigmented inks or the like, or just be roughened, for the purpose hereinafter made clear in connection with the description that is directed to the showing of FIG. 2.

The spots 48 of increased frictional characteristics are disposed in congruent relation (see FIG. 1A) in a bag pad 10 through the thickness or depth of the bag pad.

As is also indicated in FIGS. 1 and 1A, the front and rear panels 22 and 24 of each bag are punctured through the thickness or depth of the bag pad and within the confines of the spot 48 to, as at 51, in the form of FIGS. 1 and 1A, define in the respective bag front and rear panels, flaps 50 that are provided to secure or anchor the bag pad to the form of dispenser 12 shown in FIGS. 2-4.

Referring now to the dispenser 12, which is formed from a sheet or lamina 60 that is in turn formed from a suitable metal, such as stainless steel, to define a generally U-shaped bag pad holder portion 62 defining spaced holder side 64 and base side 66 that are integrally connected by connecting section 68 to define the generally U-shaped configuration indicated that is to receive, in accordance with the invention, the header 36 of the bag pad 10. As indicated in FIGS. 3 and 4, the holder side 64 has affixed thereto, as by employing a suitable bonding or welding technique, a metallic strip 70 having a tab end portion 72 of generally rounded configuration that projects outwardly of the dispenser holder side 64 and within the dispenser holder portion bag pad receiving opening 74. The tab portion 72 of the strip 70 serves a bag pad header holding function that will be disclosed hereinafter.

As indicated in FIGS. 2 and 4, the dispenser base side 66 merges into a planar abutment section 80 that in turn merges into and is in one piece relation with mounting flange 82 that in the form of FIGS. 2 and 4 is to be applied to, for instance, the counter top 14 by affixing thereto adhesive strip 84 that is one of the commonly available type having two adhesive faces 86 and 88, and offered by such companies as the 3 M Company. The strip 84 is preapplied to the underside 90 of the flange 84 in the position indicated in FIGS. 2 and 4 for mounting at a convenient edge portion of the counter top 14 that is commonly located at the bagging station where bagging personnel bag for the customer the customer's purchase in bags such as bags 20.

The bag pad 10 is applied to the dispenser 12 by holding the bag pad at essentially the level relation shown in FIG. 1, turning the bag pad upside down, slipping the header 36 of the bag pad through the opening 74 of the dispenser holder, with the bag 20 that is to be first removed from the bag pad bearing on the mounting flange 82, and then turning the bag pad 10 approximately one hundred eighty degrees, about the opening 74 serving as a pivot, and released, so that the bag pad 10 hangs vertically in the manner indicated in FIG. 2 and rests on the holder side 64. This action induces the dispenser tab portion 72 to enter the puncture 51 through the bag pad that is defined by the consecutive bag panel flaps 50 whereby the bag pad header 36 is held within the dispenser holder portion 62.

The dispenser 12 may be mounted on the counter 14 in the manner indicated in FIGS. 2 and 4 if the dispenser 12 has not previously been applied to the counter as indicated. It is to be noted that the adhesive strip 84 removably fixes the dispenser 12 to the surfacing 94 of the counter (after the usual cover for face 88 is removed) with the dispenser segment 80 disposed in bracing relation to the counter side edge surfacing 96 of counter top edge portion 92.

The dispenser 16 in FIGS. 5 and 6 is similarly arranged except that it is intended that the dispenser 16 be in one piece form, and be made from a suitable plastic material such as polyvinyl chloride extruded in long strips and cut to approximately the length of the dispenser 12. For this purpose, instead of the dispenser 16 being provided with anything comparable to the strip 70 and its tab portions 72, the holder portion 62A of the dispenser defines a resilient flange 100 that extends the length of the dispenser 16 and applies it by a biasing gripping action to the bag pad header 36 when the same is applied thereto. For this purpose, bag pads 10 applied to the dispenser 16 do not require the through puncture 51 resulting in the bag flaps 50 that are shown in FIGS. 1 and 1A. The remaining components of dispenser 16 are similar to corresponding components of dispenser 12, and are marked with the same reference numerals accompanied by the suffix "A".

In connection with both the disclosed dispenser embodiments of the invention, assuming that the bag pad 10 has been applied to one of the dispensers 12 or 16, and such dispenser has been mounted in the manner indicated in FIGS. 2 and 4 (the dispenser 12 is shown in FIGS. 2 and 4, but the operation of the dispensing arrangement is similar for both and will be described in connection with the dispenser 12), the header 36 of the bag pad will be lodged within the dispenser holder portion 62 in the manner indicated in FIG. 2, with the tear off section 42 as defined by the congruent tear off lines 40 of the individual bags 20 of the bag pad 10 located approximately as indicated in FIG. 2. When it is desired to remove a bag 20 from the bag pad 10, the bagger applies finger pressure on the spot 48 of the front panel 22 of the bag 20 that is exposed, and moves his finger in the direction of the arrow 102, which will cause, due to the increased coefficient of friction that has been provided for, sliding movement of the bag front panel 22, relative to its rear panel 24, sufficiently to effect separation of same from the header 36 along the indicated tear off line 40 of same, to open the bag 20 free of deflection of such exposed bag front panel away from such exposed bag rear panel. Here the bagger has two options; he can either leave the rear panel 24 of the bag 20 being removed connected to the bag pad header 36 and load the bag while it remains connected with the header 36, or he can grasp the bag 20 that is being removed at the lower end of same and pull such bag to the right of FIG. 2 to fully separate the bag from the bag pad header 36 and thus from the dispensing device employed.

The bag pad 110 (see FIGS. 7 and 8) comprises a plurality of individual bags 120 in flattened, stacked, and congruent relation, with the number of bags 120 in a bag pad 110 again depending on the needs of the customer for same, though for an example the bags may vary from about twenty-five to about one hundred in number.

The bags 120 are identical in configuration and make up, and each comprises a front panel 122 and a back panel 124 formed from plastic sheeting and sealed together to define the bag bottom seals 126 and the bag end or side seals 128 and 130, whereby the individual bags 120 are continuously sealed along their sides 129 across their bottoms 131 and along their sides 133.

The bag pad 120 thus defines a lower end 132 and an upper end 134, with the bag pad upper end 134 defining the bag pad header 136 that extends downwardly from the top 138 of the bag pad 110 to tear off lines 140 that are formed in each bag pad front and rear panel 122 and 124 and that in assembling of the bag pad 110 are stacked in congruent relation so as to define a tear off section 142 of the bag pad 110 (that is similar to the bag pad section 42 of bag pad 10). The header 136 in the form shown for bag pad 110 is also formed with a pair of apertures 144 that extend through the thickness or depth of the bag pad header 136 and are formed by conventional heat sealing methods so as to affix the consecutively stacked bags 120 together at apertures 144 whereby the header 136 remains assembled as the individual bags 120 are removed from the bag pad. Apertures 144, as in the case of bag pad 10, may be hung on nails or hooks that are applied to the respective holes 144, but the principal use envisioned for bag pad 110 is in connection with one of the dispensers 12 or 16.

It will be understood, of course, that the tear off lines 140 are actually lines of rectilinear perforations 143 that facilitate tear off of the individual bags 120 from the bag pad 110, as in the case of bag pad 10.

Further in accordance with the invention, the external surface 146 of each bag front panel 122 has an area 148 of increased frictional characteristics, as compared to the inner surfacings of the individual bag front and rear panels 122 and 124, formed thereon, and preferably in pairs 149, with the areas 148 of each pair 149 being disposed on either side of the longitudinal axis of the respective bags 110. The areas 148 of each bag 120 may be formed from any suitable material, such as a spot of pigmented ink or the like, or just be roughened, for the same purpose made clear in connection with the description that is directed to the showing of FIG. 2.

The areas or spots 148 of each pair of pair 149 of such areas of increased frictional characteristics are disposed in congruent relation in the bag pad 110 through the thickness or depth of the bag pad.

As is also indicated in FIGS. 7 and 7A, the front and rear panels 122 and 124 of each bag (of the bag pad 110) are punctured through the thickness or depth of the bag pad as at 151 to define in the respective bag front and rear panels, flaps 150 that are provided to secure or anchor the bag pad 110 to the form of dispenser 12 shown in FIGS. 2–4. The tear off lines 140 of the respective bags 120 are discontinuous across the flaps 150 in the bag pad 120, as at 153.

The front and rear panels 122 and 124, of each of the bags 120 of bag pad 110, are also formed adjacent but below the level of the respective tear off lines 140, with a pair 160 of through punctures 162 and 163 that form a pair 164 of lobular flaps 166 and 167 in the front and rear panels of each bag 120 (of the bag pad 110). The lobular flaps 166 and 167 extend heightwise or lengthwise of the bag pad bags 120, with the respective flaps 166 and 167 of each bag panel having a common frangible connection 168 to the panel, adjacent their respective upper ends, and a common non-frangible connection 170 to the bag panel forming same. The lobular flaps 166 and 167 of the individual bag front and rear panels provide the hand hold apertures 172 that are indicated in FIG. 10, as will be subsequently described, when the individual bags 120 are fully removed from the bag pad 110.

The bag pad 110 is applied to the dispenser 12 by holding the bag pad 110 at essentially the level relation shown in FIG. 7, turning the bag pad upside down, slipping the header 136 of the bag pad 110 through the opening 74 of the dispenser holder 12, with the bag 120 that is to be first removed from the tag pad 110 bearing on the dispenser mounting flange 82, and then turning the bag pad 110 approximately one hundred eighty degrees, about the opening 74 serving as a pivot, and released, so that the bag pad 110 hangs vertically in the manner indicated in FIG. 8 and rests on the holder side 64. This action induces the dispenser tab portion 72 to enter the puncture 151 through the bag pad 110 that is defined by the consecutive bag panel flaps 150, whereby the bag pad header 136 is held within the dispenser holder portion 62.

The dispenser 12 may be mounted on the counter top 14 in the manner indicated in FIGS. 2 and 4 if the dispenser 12 has not previously been applied to the counter top as indicated. It has been noted that the adhesive strip 84 removably fixes the dispenser 12 to the top of the counter (after the usual cover for face 88 is removed) with the dispenser segment 80 disposed in bracing relation to the counter side edge surfacing 96.

It will be apparent that bag pad 110 is also applicable to the aforedescribed dispenser 16. For this purpose, bag pads 110 applied to the dispenser 16 do not require the through puncture 151 (resulting in the bag flaps 150 that are shown in FIGS. 7 and 7A), and the tear off lines 140 of each bag panel may be continuous transversely across the panel.

In connection with the bag pad 110, assuming that the bag pad 110 has been applied to one of the dispensers 12 or 16, and such dispenser has been mounted in the manner indicated in FIGS. 2, 4 and 8 (the dispenser 12 is the dispenser shown in FIGS. 8 and 9, but the operation of the dispensing arrangement is similar for both dispensers and will be described in connection with the dispenser 12), the header 136 of the bag pad 110 will be lodged within the dispenser holder portion 62 in the manner indicated in FIGS. 8 and 9, with the tear off section 142 as defined by the bag pad congruent tear off lines 140 of the individual bags 120 located approximately as indicated in FIG. 8. When it is desired to remove an exposed bag 120 from the bag pad 110, the bagger applies finger pressure on one of the areas or spots 148, of the front panel 122 of the bag 120 that is exposed, and moves his finger in the direction of the arrow 202, which will cause the exposed bag front panel 122 to separate sufficiently from the bag pad header 136 along the indicated tear off line 140 of same, to open the bag 120. This result may also be achieved by similarly using the other area or spot 148 of the exposed bag pair 149. In either event the bagger has two options; he can leave the rear panel 124 of the bag 120 being removed connected to the bag pad header 136 and load the bag while it remains connected with the header 136, or he can grasp the bag 120 that is being removed, at the lower end of same, and pull such bag to the right of FIG. 8 to fully separate the bag from the bag pad header 136 and thus from the dispensing device employed.

Once the exposed bag 120 is removed from the dispenser 12, the bagger may push one or more of his fingers of one hand against the flaps 166 and 167 of both panels of the bag 120, fracturing the frangible connection 168, forming apertures 172 in both the bag panels, and pushing out of the way the common flap 169 (that is formed in each bag panel by the integrally united flaps 166 and 167), so that the tops of the bags may be brought together over the bag contents before that bag is transferred to the customer (see FIGS. 10 and 10A), who can grasp the indicated bag in a similar manner. The flap 169 of the bag front panel 122 that is formed by this action of the bagger is pushed inside of the bag 120, and thus is not visible in the showings of FIGS. 10 and 10A, but assumes the depending relation illustrated in FIG. 10A for bag rear panel 124.

It will thus be seen that the dispensing of the bags from bag pads 10 or 110 using a dispenser 12 or 16 has a number of advantages.

For instance, the dispenser employed can be secured to the counter top surfacing 94 and the bags of the bag pads 10 or 110 hung vertically without taking up or using any valuable counter work space. Further, when a bag is removed from the bag pad it is fully opened and therefore immediately ready for bagging use. Applying the bags in a bag pad 10 or 110 avoids the problem of the adverse effect on separate bags by unexpected air currents.

As the areas or spots 48 or 148 of the bag pad applied to a particular dispenser 12 or 16 are to be disposed in substantially a horizontal mode (see FIGS. 2 and 8), they can readily be seen by the bagger, and they are easy to use to open a bag. The suggested pigmented ink, or just roughening the bag front panels where indicated, provides a semi-tacky or tacky like spot 48 or 148 having increased frictional characteristics that when pressed and actuated by the bagger, provide a coefficient of friction between the spot 48 or 148 that is finger pressed, and the bagger's finger that is significantly greater than that between the panel interior surfacings of the bag being opened (the exposed bag), which interior surfacings as well as the bag panel exterior surfacings except for the spots 48 and 148 have near zero frictional characteristics, as is well known in the art.

The result is that when the bagger's finger is pressed against a bag spot 48 or 148 and is moved in the direction of the arrows 102 or 202, the separation of the exposed bag front panel from the bag pad header (36 or 136) is easily effected along the tear off lines 40 or 140 for the bag 20 or 120 being processed. While tackiness of the areas or spots 48 or 148, as such, is not required, the spots 48 or 148 need to be so formed, either by application of a suitable substance to the individual bags involved in each bag pad 20 or 120, or by roughing (as indicated), that they have frictional characteristics that are substantially greater than the external and internal surfacings of the bag panels, which are slippery, and thus of low or near zero frictional characteristics (since bags making up bag pads in this art are normally formed from a suitable plastic material, such as polyethylene or polypropolene, or the like, in sheeting or tube form).

It has been found that removal of exposed bags from a header 36 or 136 at or near the bottom of the bag pad involved is just as easy as removal of exposed bags of a fresh bag pad 20 or 120.

It also comes within the scope of the invention that the mounting flange 82 or 82A may be oriented relative to the dispenser holder portion 60 to mount same on a vertical surface, such as a wall adjacent the bagger's position. Also, instead of adhesive, the flange 82 may be mounted in position using screws or other common types of mechanical securing devices, or even being directly bonded in place.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A bag pad comprising:

a plurality of bags of similar size and perimeter in stacked, flattened, relation, said bags each being in the form of a bag of flexible plastic material of film thickness dimensions defining front and rear panels that define internal surfacings and that are sealed together at the bottom and sides of the bag, said front and rear panels of each bag being in side by side relation and extending from the bottom to the top of the bag, said front and rear bag panels of said bags being in substantial congruent relation in said pad, said panels of each of said bags each defining a tear off line extending transversely of the bag and adjacent but spaced from the top of the bag, said bag panel tear off lines being located in congruent relation in said pad and defining a bag pad bear off section, said bags being heat sealed together adjacent said bag tops to define a bag pad header extending to said bag tear off lines, with said front panel of each said bag of said bag pad having an area of increased frictional characteristics on the exterior of same below but adjacent said tear off line thereof, with said areas being of increased frictional characteristics as compared to the frictional characteristics of the respective bag panel internal surfacings and being congruently located throughout said pad for using finger pressure to, for the individual bags of the bag pad that are exposed for tear off, separate the exposed bag front panel from its rear panel at the tear off line of the exposed bag front panel, said bag pad being punctured therethrough adjacent but below said bag pad tear off section for fixedly mounting said pad against movement longitudinally of said bags, said areas comprise each bag front panel having a pair of said areas below but adjacent said tear off line thereof, said areas of said pair of said areas of the respective bags being disposed to either side of said bag pad puncture.

2. The bag pad set forth in claim 1 wherein:

said bag pad below said puncture is formed with a pair of lobular punctures that are spaced transversely of said bag pad, said lobular punctures forming in each panel of each bag of said bag pad a lobular flap extending depthwise of said bags, respectively, said lobular flaps of one of said lobular punctures being congruently located throughout said pad, and said lobular flaps of the other of said lobular punctures being congruently located throughout said pad, said lobular flaps being respectively frangibly connected to the respective bag panels in which they are formed, whereby, when an exposed bag of said bag pad is separated therefrom, said lobular flaps of said separated bag said front and rear panels may be finger punched to define congruently located finger receiving apertures for drawing the front and rear panels of the separated bag together and hand holding of the separated bag in a carry away manner.

3. The bag pad set forth in claim 2 wherein:

said frangible connections of the respective lobular flaps are adjacent the upper ends of same.

4. A bag comprising:

a plurality of bags of similar size and perimeter in stacked, flattened, relation, said bags each being in the form of a bag of flexible plastic material of film thickness dimensions defining front and rear panels that define internal surfacings and that are sealed together at the bottom and sides of the bag, said front and rear panels of each bag being in side by side relation and extending from the bottom to the top of the bag, said front and rear bag panels of said bags being in substantial congruent relation in said pad, said panels of each of said bags each defining a tear off line extending transversely of the bag and adjacent but spaced from the top of the bag, said bag panel tear off lines being located in congruent relation in said pad and defining a bag pad bag tear off section, said bags being heat sealed together adjacent said bag tops to define a bag pad header extending to said bag tear off lines, with said front panel of each said bag of said bag pad having an area of increased frictional characteristics on the exterior of same below but adjacent said tear off line thereof, with said areas being of increased frictional characteristics as compared to the frictional characteristics of the respective bag panel internal surfacings and being congruently located throughout said pad for using finger pressure to, for the individual bags of the bag pad that are exposed for tear off, separate the exposed bag front panel from its rear panel at the tear off line of the exposed bag front panel, said bag pad being punctured therethrough adjacent but below said bag pad tear off section for fixedly mounting said pad against movement longitudinally of said bags, said pad puncture being centered on the bag pad, said puncture forming in said panels of said bags of said pad a depending flap, said flaps being congruently located throughout said pad.

5. A bag pad comprising:

a plurality of bags of similar size and perimeter in stacked, flattened, relation, said bags each being in the form of a bag of flexible plastic material of film thickness dimensions defining front and rear panels that define internal surfacings and that are sealed together at the bottom and sides of the bag, said front and rear panels of each bag being in side by side relation and extending from the bottom to the top of the bag, said front and rear bag panels of said bags being in substantial congruent relation in said pad, said panels of each of said bags each defining a tear off line extending transversely of the bag and adjacent but spaced from the top of the bag, said bag panel tear off lines being located in congruent relation in said pad and defining a bag pad bag tear off section, said bags being heat sealed together adjacent said bag tops to define a bag pad header extending to said bag tear off lines, with said front panel of each said bag of said bag pad having an area of increased frictional characteristics on the exterior surfacing of same below but adjacent said tear off line thereof, with said areas being of increased frictional characteristics as compared to the frictional characteristics of the respective bag panel internal surfacings and being congruently located throughout said pad for using finger pressure acting in the direction of the bag bottom to, for the individual bags of the bag pad that are exposed for tear off, effect sliding movement of the exposed bag front panel relative to the exposed bag rear panel so as to separate the exposed bag front panel from its rear panel at the tear off line of the exposed bag front panel free of deflection of the exposed bag front panel from the exposed bag rear panel.

6. The bag pad set forth in claim 5 wherein:

said areas are substantially centered on the respective bags.

7. The bag pad set forth in claim 5 wherein:

said areas comprise each bag front panel having a pair of said areas below but adjacent said tear off line thereof, said areas of said pair of said areas of the respective bags being disposed to either side of the respective said bag front panels.

8. The bag pad set forth in claim 7 wherein:

said bag pad bags centrally thereof and below said tear off line thereof being formed with a pair of lobular punctures that are spaced transversely of said bag pad, said lobular punctures forming in each panel of each bag of said bag pad a lobular flap extending depthwise of said bags, respectively, said lobular flaps of one of said lobular punctures being congruently located throughout said pad, and said lobular flaps of the other of said lobular punctures being congruently located throughout said pad, said lobular flap being frangibly connected to the respective bag panels in which they are formed, whereby, when an exposed bag of said bag pad is separated therefrom, said lobular flaps of said separated bag said front and rear panels may be finger punched to define congruently located finger receiving apertures for drawing the front and rear panels of the separated bag together and hand holding of the separated bag in a carry away manner.

9. The bag pad set forth in claim 8 wherein:

said frangible connections of the respective lobular flaps are adjacent the upper ends of same.

10. A bag pad and dispenser therefor, said bag pad comprising:

a plurality of bags of similar size and quadrilateral perimeter in stacked, flattened, relation, said bags each being in the form of a bag of flexible plastic material of film thickness dimensions defining front and rear panels that define external and internal surfacings and that are sealed together at the bottom and sides of the bag, said front and rear panels of each bag being in side by side relation and extending from the bottom to the top of the bag, said front and rear bag panels of said bags being in substantial congruent relation in said pad, said panels of each of said bags each defining a tear off line extending transversely of the bag and adjacent but spaced from the top of the bag, said bag panel tear off lines being located in congruent relation in said pad, said bags being heat sealed together adjacent said bag tops to define a rectilinear bag pad header extending longitudinally of and above said bag tear off lines, with said front panel external surfacing of each of said bags of said bag pad having an area of increased frictional characteristics on same below but adjacent said tear off line thereof, with said areas being of increased frictional characteristics as compared to the frictional characteristics of the bag panel internal surfacings, and being congruently located throughout said pad, said dispenser comprising a sheet member formed to define:

a generally U shaped bag pad holder portion defining spaced upper holder and lower base sides that in turn define a generally quadrilateral pocket that is closed thereabout except for an opening along said dispenser holder side that is coextensive with said pocket, said pocket being proportioned depthwise to seat the bag pad header therein, said dispenser including means for holding the bag pad in its said bag tear off relation in said pocket, said dispenser further including a mounting flange disposed along said dispenser base side, and means for fixedly mounting said mounting flange to fixedly dispose said dispenser in its bag dispensing relation, whereby, when the bag pad header is passed into said pocket through said dispenser opening upside down and the bag pad is inverted at said opening, the bag pad may be draped across said dispenser holder side to depend from said dispenser to form the bag tear off relation of the bag pad relative to said dispenser, with said mounting flange being oriented relative to said dispenser holder portion to dispose the bag pad having its header seated in said pocket to hang vertically from said dispenser in said bag tear off relation of same with the bag pad overlying said dispenser holder side.

11. The bag pad and dispenser therefor set forth in claim 10 including:

means for releasably holding said bag header in said dispenser pocket.

12. The bag pad and dispenser therefor set forth in claim 10 wherein in said bag pad:

said areas are substantially centered on the respective bags.

13. The bag pad and dispenser therefor set forth in claim 10 wherein in said bag pad:

said areas comprise each bag front panel having a pair of said areas below but adjacent said tear off line thereof, said areas of said pair of said areas of the respective bags being disposed adjacent to either side of said front panel external surfacing thereof.

14. The bag pad and dispenser therefor set forth in claim 10 wherein:

said bag pad is punctured therethrough adjacent to but below said bag pad tear off lines, said pad puncture being centered on the bag pad, said puncture forming in said panels of said bags of said pad a depending flap, said flaps being congruently located throughout said pad, said means for releasing holding said bag pad header in said dispenser pocket comprising an elongate member extending transversely of said pocket and fixed to said bag holder portion of said dispenser and being in penetrating relation with the bag pad header at said puncture.

15. The bag pad and dispenser therefor set forth in claim 10 wherein:

said bag dispenser holder portion being oriented relative to said mounting flange thereof such that said dispenser holder side is in a substantially horizontally oriented mode relative thereto when said dispenser is in its bag dispensing relation, with said areas of said bag pad being located to be supported by said dispenser holder side when said dispenser is in its bag dispensing relation.

* * * * *